United States Patent [19]

Schreder et al.

[11] Patent Number: 4,900,899

[45] Date of Patent: Feb. 13, 1990

[54] COOKING UNIT WITH RADIANT HEATERS

[75] Inventors: Felix Schreder; Gerhard Gössler, both of Oberderdingen, Fed. Rep. of Germany

[73] Assignee: E.G.O. Elektro-Gerate Blanc u. Fischer, Fed. Rep. of Germany

[21] Appl. No.: 246,407

[22] Filed: Sep. 19, 1988

Related U.S. Application Data

[62] Division of Ser. No. 18,945, Feb. 25, 1987, Pat. No. 4,778,978.

[30] Foreign Application Priority Data

Feb. 26, 1986 [DE] Fed. Rep. of Germany ..... 3606117
Apr. 24, 1986 [DE] Fed. Rep. of Germany ..... 3613902

[51] Int. Cl.[4] ..... H05B 3/74
[52] U.S. Cl. ..... 219/464; 219/466
[58] Field of Search ..... 219/464, 465, 466, 467, 219/458, 459, 460, 461, 463

[56] References Cited

U.S. PATENT DOCUMENTS

| | | | |
|---|---|---|---|
| 1,717,270 | 6/1929 | Shroyer | 219/464 |
| 3,567,906 | 3/1971 | Hurko | 219/464 |
| 3,987,275 | 10/1976 | Hurko | 219/464 |
| 4,237,368 | 12/1980 | Welch | 219/449 |
| 4,363,956 | 12/1982 | Scheidler et al. | 219/464 |
| 4,551,616 | 11/1985 | Buttery | 219/460 |
| 4,556,786 | 12/1985 | Frost et al. | 219/464 |

FOREIGN PATENT DOCUMENTS

| | | | |
|---|---|---|---|
| 208473 | 4/1960 | Austria . | |
| 238331 | 6/1964 | Austria . | |
| 312759 | 1/1974 | Austria . | |
| 2042427 | 3/1972 | Fed. Rep. of Germany . | |
| 2142692 | 3/1973 | Fed. Rep. of Germany | 219/464 |
| 2164162 | 6/1973 | Fed. Rep. of Germany . | |
| 2165569 | 7/1973 | Fed. Rep. of Germany | 219/464 |
| 2242823 | 3/1974 | Fed. Rep. of Germany . | |
| 7705618 | 6/1977 | Fed. Rep. of Germany . | |
| 2950302 | 6/1981 | Fed. Rep. of Germany . | |
| 3002623 | 7/1981 | Fed. Rep. of Germany . | |
| 3007037 | 9/1981 | Fed. Rep. of Germany . | |
| 3018416 | 11/1981 | Fed. Rep. of Germany . | |
| 8136893 | 6/1982 | Fed. Rep. of Germany . | |
| 3037965 | 10/1982 | Fed. Rep. of Germany . | |
| 3204119 | 11/1982 | Fed. Rep. of Germany . | |
| 3229380 | 2/1983 | Fed. Rep. of Germany . | |
| 3204760 | 8/1983 | Fed. Rep. of Germany . | |
| 3209260 | 9/1983 | Fed. Rep. of Germany . | |
| 3234349 | 3/1984 | Fed. Rep. of Germany . | |
| 3413650 | 10/1984 | Fed. Rep. of Germany . | |
| 3327622 | 2/1985 | Fed. Rep. of Germany . | |
| 3335066 | 4/1985 | Fed. Rep. of Germany . | |
| 3410442 | 9/1985 | Fed. Rep. of Germany . | |
| 3443529 | 5/1986 | Fed. Rep. of Germany . | |
| 543223 | 8/1922 | France . | |
| 1340411 | 9/1963 | France . | |
| 375692 | 6/1932 | United Kingdom . | |
| 714373 | 8/1954 | United Kingdom . | |
| 2100853 | 1/1983 | United Kingdom . | |

*Primary Examiner*—Teresa J. Walberg
*Attorney, Agent, or Firm*—Steele, Gould & Fried

[57] ABSTRACT

In a cooking unit (1) in the marginal region of the underside of hotplate (3) a tensile stressed support (4) is fixed immediately adjacent to the outer circumference (8) of a radiant heater (2). Support (4) engages below a cover (13) of the insulation of radiant heater (2) serving as a base plate and at least one spring (22) is arranged between a marginal strip (16) and the underengaging leg (19), so that a prestressed, closed assembly for fitting in a hob or the like is formed. Appropriately there are several closely juxtaposed, rectangular radiant heaters (4) with in each case separately switchable or regulatable heating circuits, so that at least approximately 85% of the total surface of the cooking field can be directly heated.

18 Claims, 6 Drawing Sheets

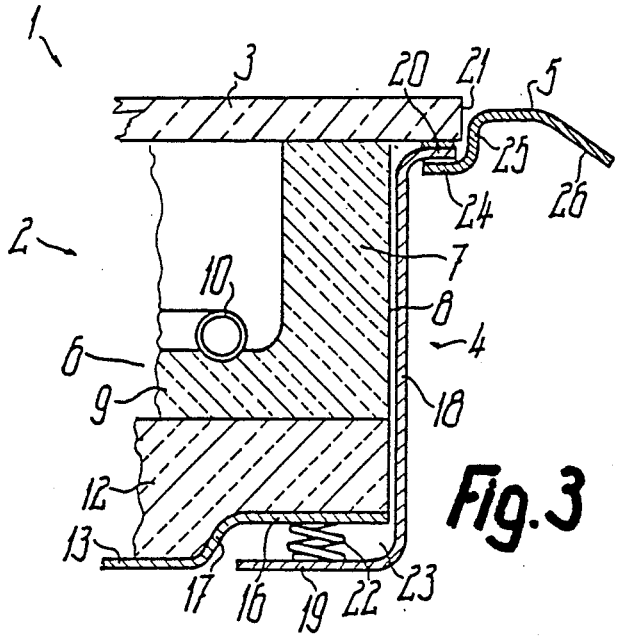
Fig. 3
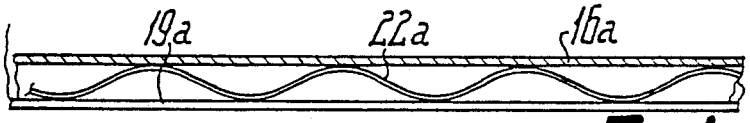
Fig. 4
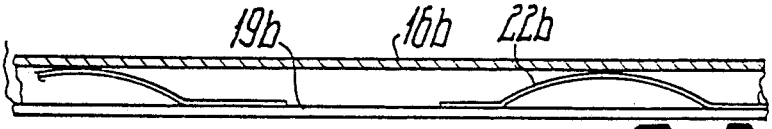
Fig. 5
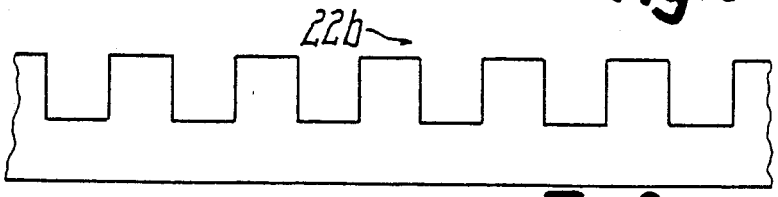
Fig. 6
Fig. 7
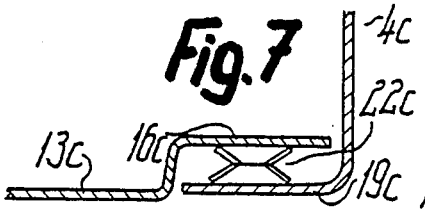
Fig. 8
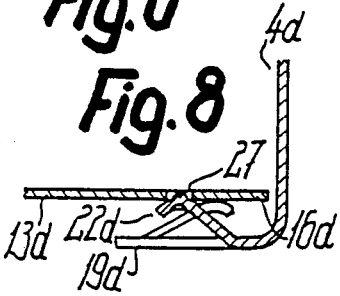

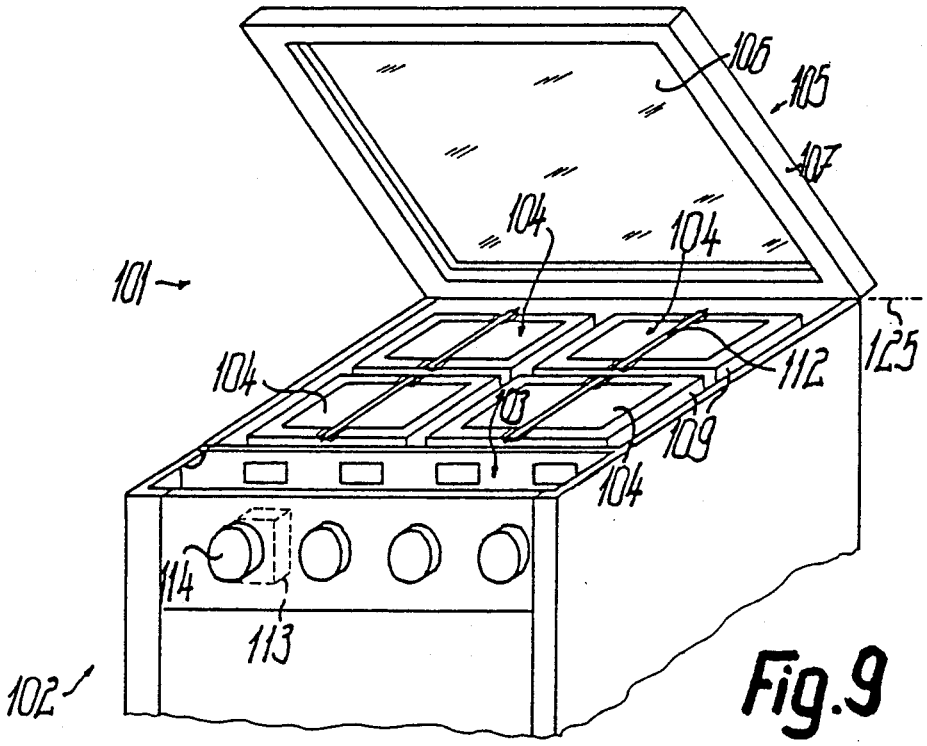
Fig.9
Fig.10
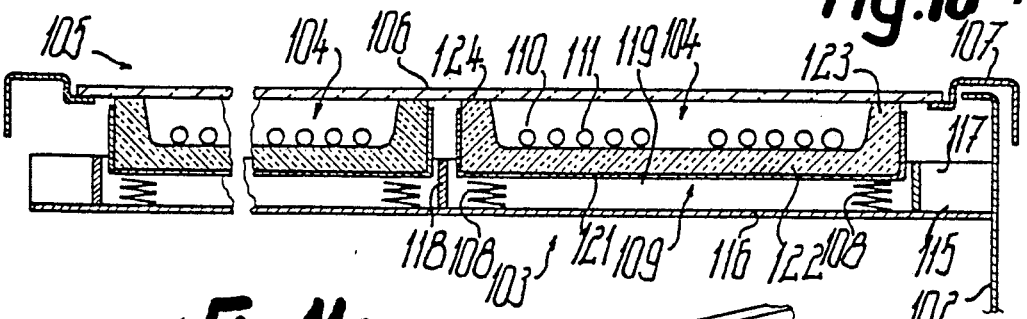
Fig.11a
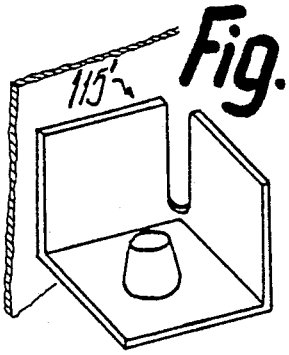
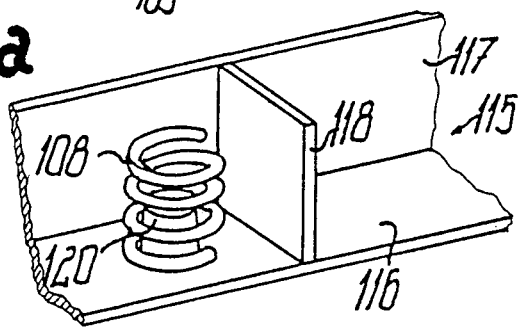
Fig.11

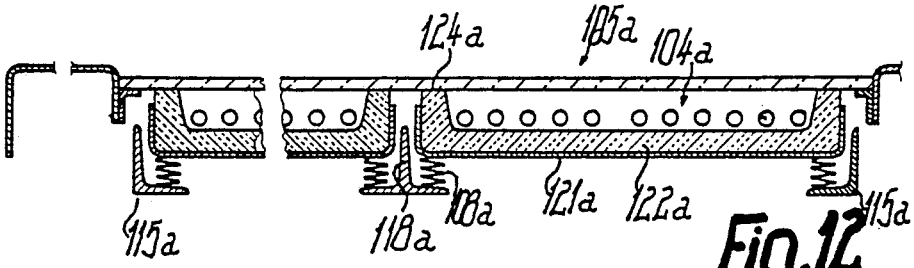
Fig.12
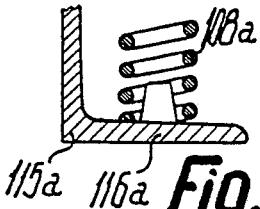
Fig.13
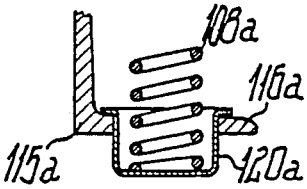
Fig.14
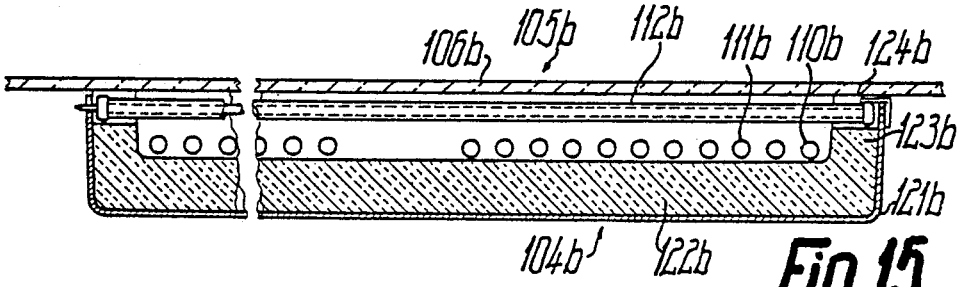
Fig.15
Fig.16
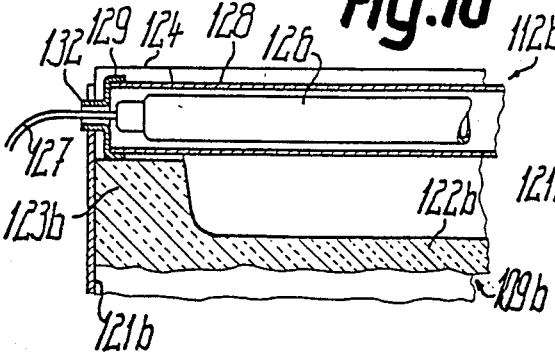
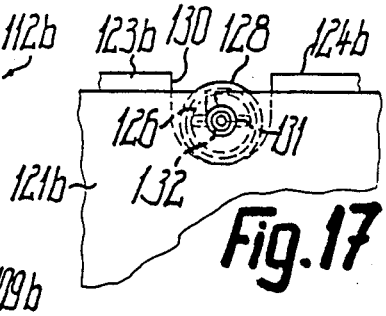
Fig.17

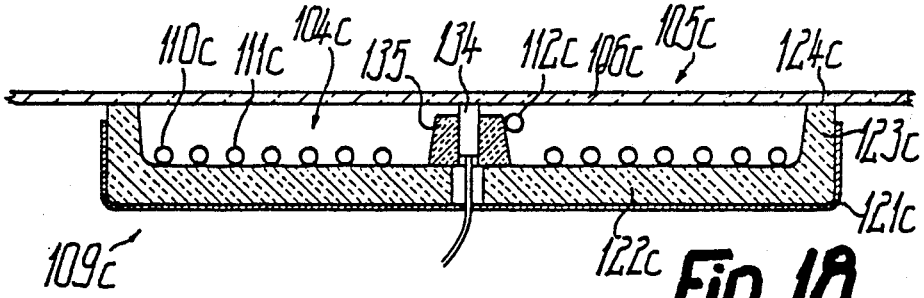
Fig. 18
Fig. 19
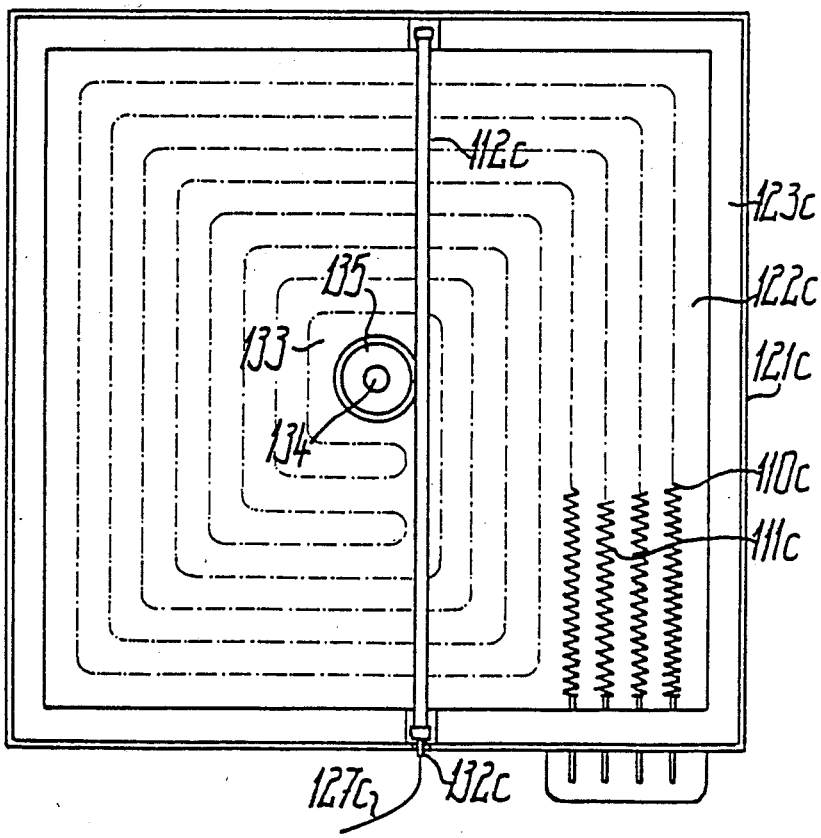

COOKING UNIT WITH RADIANT HEATERS

CROSS REFERENCE TO RELATED APPLICATION

This is a division of application Ser. No. 018,945, filed Feb. 25, 1987, now U.S. Pat. No. 4,778,978.

BACKGROUND OF THE INVENTION

The present invention relates to a cooking unit, particularly for industrial cookers or the like, with e.g. a glass ceramic hotplate, which is provided on its back surface with at least one radiant heater, which has an insulator with at least one radiant element.

An objects of the present invention is to provide a cooking unit of the aforementioned type, which ensures simple assembly in the case of a reliable connection between the radiant heater and the hotplate.

In the case of cooking units of the present type, the glass ceramic plate as such can be fixed to the hob, followed by the fixing of a number of radiant heaters, which constitute separate assemblies, corresponding to the number of cooking points to be provided on the hob. This can easily lead to assembly errors. When using radiant heaters as a heat source, it is particularly important that the insulator firmly engages against the underside of the hotplate, which is brought about by using springs, which are generally positioned or inserted during assembly.

For achieving the objects of the invention, it is also advantageously possible in the case of a cooking unit of the aforementioned type that between the support and the radiant heater is provided at least one spring pressing the same against the hotplate. Unlike in an assembly, where the radiant heater is connected without springs rigidly to the hotplate, this leads to an arrangement in which, within the assembly, the radiant heater is movably mounted with respect to the hotplate at least about a spring displacement at right angles to the hotplate and is pressed against the latter by springs, so that prior to the assembly of the cooking unit in the hob the resiliently pressed engagement of the insulator on the hotplate is obtained and can be checked.

The construction can be significantly simplified in that there are no carrying clips running at right angles over the underside of the radiant heater and instead the support is formed by at least one carrying frame running from the hotplate to the back of the radiant heater and in particular constituted by a bent section and which engages round the back surface of the radiant heater only in the associated border region, so that particularly from the height standpoint the cooking unit takes up little space. The spring can be located between a leg of the support engaging round the back of the radiant heater and the back of said heater, so that it is arranged in a completely sealed and space-saving manner and only requires a very small spring extension in the spring direction making it possible to use relatively rigid springs.

In a particularly advantageous embodiment the back surface of the radiant heater is offset in the vicinity of the support engaging round it, preferably in such a way that the back of the heater is located outside the offset region in a single plane with the engaging round part of the support. Thus, the underside of the cooking unit can be substantially planar over its entire extension, which is particularly advantageous concerning the stackability of the cooking unit, but also facilitates installation.

According to a further development of the invention the spring is supported on a sheet metal or similar cover provided on the insulator which, unlike in the case of a shell-like cover receiving the insulator is preferably formed by an approximately planar base plate leaving the outer circumference of the insulator free, which leads to a further constructional simplification. Appropriately this base plate has the same plan form as the insulator, so that the outer edge surface of the former terminates with the outer circumferential surface of the latter. This cover is advantageously suitable within the outer circumference, particularly in the vicinity of the central cutout, to provide a mounting for a connecting body for the electrical connection of the radiant heater, which can be substantially completely countersunk within the insulator or a central cutout provided therein.

For protecting the outer circumference of the insulator, particularly if it is not surrounded by the cover, it is appropriate for the support to cover the outer circumference of the insulator, especially engaging approximately on the outer circumference, the support appropriately passing in uninterrupted manner over the outer circumference or the outer edge of the insulator.

A high mechanical strength of the closed assembly is obtained if the support forms a frame surrounding the radiant heater.

In an extremely simple manner the support can be connected to the hotplate in that, particularly by means of an outwardly directed leg it is bonded to the hotplate in heat-proof manner, e.g. using a silicone adhesive. The support is appropriately completely located within the outer edges of the hotplate, so that bonding only takes place on the underside of the hotplate.

On the outer circumference of the hotplate it is possible to provide a carrying rim, which is advantageously fixed to the support or to the hotplate or to both these parts by bonding or the like. In the case of bonding with respect to the hotplate, this appropriately takes place with respect to its associated edge surface. It is particularly appropriate if the carrying rim engages below the support, particularly its outwardly directed leg, so that the carrying rim forms a bearing surface for the support and therefore for the hotplate directly over it.

The spring can be constructed in a simple manner as a leaf, corrugated, fastening, cup or similar spring.

According to the invention one hotplate of the cooking unit can be provided on its underside with a corresponding number of separate radiant heaters for forming several separately switch-selectable, adjacent cooking points within a cooking field. The radiant heater is provided with at least one radiant element located in a support shell and which forms a heating field, whilst supported on a substructure it is pressed by springs against the underside of the heating plate.

Electric cookers for cooking large amounts of food, such as are used in industrial kitchens, canteens and the like, generally have as cooking points electric hotplates with hotplate bodies made from cast iron, which are introduced into a hob. Such cookers have proved advantageous from many respects, but there is still a need for easier handling, a lower energy consumption together with more rapidly responding power provision and easier maintenance and repair than is possible with the cooker known from British Pat. No. 714 373.

The object of the present invention is therefore to provide a cooking unit of the described type making it possible, in the case of a substantially jointless, liquid-tight construction of the hotplate to provide use regions passing uninterruptedly into one another, which can be heated in such a way that the heating of numerous different heat flow diagrams under one or more cooking utensils placed on the hotplate can be adjusted.

In the case of a cooking unit, particularly of the latter type, the invention solves this problem in that each radiant heater is substantially non-displaceably inserted in a receptacle of the substructure adapted to the external heater dimensions and that the receptacles are approximately directly adjacent to one another, in such a way that the cooking field can be heated substantially without interruption and over at least approximately 85% of its total surface. The cooking field is the field defined by the outer boundaries of an associated group of radiant heaters, so that the hotplate can be larger than this cooking field. Within this cooking field, each radiant heater can be operated independently of the other radiant heaters as a result of its setting or control and its technical data, so that the radiant heaters can be set in such a way that the cooking field is formed by uninterruptedly connected or thermally coalescing heating fields with the same or different power provision and the cooking utensils by movement or displacement can be moved into the desired heating field alone and into zones in which two or more adjacent heating fields act with different proportions as a function of the position of the cooking utensil. Since, with regards to the power provision, cooking units with hotplates and radiant heaters respond much more rapidly than cast metal hotplates, this construction leads to the important advantage that for obtaining a reduced energy requirement, a sensitive setting or control adapted to needs can take place without increasing the cooking times, unlike has hitherto been conventional practice in industrial kitchens the hotplates do not have to be operated at full power over their entire period of use.

For domestic cookers, cooking units with hotplates and radiant heaters are admittedly known, e.g. from DE-OS 22 42 823, which can be brought together to form a relatively large total heating surface, but this has led to the cooking field being made correspondingly smaller, which is disadvantageous due to the reduced heated surface, especially in industrial kitchen cookers. Due to rough use in industrial kitchens, the use of glass ceramic hotplates has been avoided, because such hotplates are relatively sensitive to impacts and breakages. As a result of the almost uninterrupted juxtaposing of the radiant heaters in a non-displaceable position, even in the case of relatively large overall dimensions, the underside of the hotplate is supported by support shells engaging thereon generally with a damping insulating material that there is scarcely any need to fear hotplate breakage even under the most severe conditions.

The aforementioned advantages are particularly obtained if all the radiant heaters are rectangular, particularly square and are connected to one another preferably only with slot-like gaps of a few centimetres, particularly approximately one centimetre. It is particularly advantageous if all the radiant heaters have an identical construction and are e.g. interchangeable, with regards to the rated capacity and the control or setting, to provide different radiant heaters, which appropriately have the same ground plan dimensions, so that e.g. four radiant heaters are provided which form a rectangular or square cooking field. The size of the cooking field is approximately 300×300 mm, e.g. 320×320 mm, whilst the edge dimension of the heated surface of the radiant heater is approximately 290×290 mm, so that there is a cooking field pitch similar to that of the known industrial cookers.

The receptacles can be formed in a simple manner by angular sections, on whose approximately horizontal legs are independently supported by means of spring elements the radiant heaters, so that for each heater it is possible to obtain a clearance-free, tight engagement on the underside of the hotplate, in the case of a limited total cooking unit height. Appropriately the hotplate can be removed or raised from the radiant heaters or cooking unit, very simple operation being obtained if the hotplate can be flapped up and on transferring into its operating position by application to upper end faces of outer borders of the support shells of the radiant heaters, the latter press downwards under the pretension of spring elements.

According to a particularly advantageous development of the invention, the radiant heater is operated by means of a temperature regulator or thermostat, so that there is rapid operating readiness, i.e. a heating with maximum power, but nevertheless a low energy consumption in the unloaded state, i.e. in the case where no heat is taken by a cooking utensil, so that a good power adaptation is obtained, which can e.g. be further improved by a continuously adjustable construction of the thermostat. According to another feature of the invention for influencing the thermostat, which is preferably in the form of a capillary tube regulator, between the radiant element and the underside of the hotplate is provided a temperature sensor approximately parallel to the latter and which is preferably rod-like and crosses the associated heating field over most of its associated width. Instead of a system filled with a high temperature expansion fluid it is also possible to provide an electronic or electrical thermostat, whose sensor is temperature-sensitive over its entire length. It has been found that as a result the complete heating field can be substantially uniformly detected and with regards to the overall heat flow of the particular heating field there is a very sensitive and therefore rapidly responding control.

Particularly in the case of a cooking unit of the described type, the invention further provides that a thermostat is associated with the temperature sensor and which is also constructed for temperature limiting purposes, i.e. also ensures that the hotplate does not exceed a predetermined maximum temperature. Thus, there is no need for a separate temperature limiting switch and an associated, separate sensor. In place of the temperature-regulated operation of the particular radiant heater, it is also possible to provide step switching, e.g. a four or seven-cycle circuit by means of a corresponding power control device, if the radiant heater is provided with the corresponding number of separately switch-selectable radiant heaters or heating circuits, which can then be connected in parallel and/or in series for the individual switching stages. However, in this case the hotplate is protected by a temperature limiting device in the form of a thermostat, e.g. a rod temperature regulator with a fixed setting, whose temperature sensor is constituted by a rod having different thermal expansion characteristics positioned in axially abutted manner in an outer tube and which acts on a snap switch arranged in a casing at one end of the temperature sensor. In the case of such step switching, the no-load temperature, i.e. the temperature of the heating field with no power take-off, is given by the fixed setting of the thermostat set to a relatively high temperature. In the case of a rated power of e.g. approximately 4000 W, there is an energy saving particularly if the power control device is set to at least approximately ¾ of the rated power. The temperature sensor can also be constituted by a tubular sensor similar to a tubular heater, but with temperature-dependent resistance wire, embedded within a metal tube jacket in contact-free manner and therefore in insulated form in an insulating material.

If the radiant heater operation is regulated in temperature-dependent manner, the thermal characteristic of the heating field can be adapted in a surprisingly simple manner to the requirements of industrial kitchens in that the thermostat only switches part, e.g. half the radiant heater power, whilst at least a further or the remaining part of the rated power is switched in by an additional contact of the thermostat in the upper temperature setting range. The thermostat can switch one or more radiant elements, whilst the additional contact switches the one or more other radiant elements. Thus, a low no-load power is obtained for energy saving and hotplate protection purposes and when using the cooking point in a substantially delay-free manner a maximum high power is made available, because the temperature of the cooking point is always held at a set level and if necessary a predetermined power can be switched in. Apart from a rapid operational readiness, the settable control also permits a good power adaptation to the particular conditions, so that the cooking unit can be set to zones of different power or temperature, such as for initial cooking, roasting, further cooking, as well as keeping hot or warming. Instead of this or in addition thereto, the thermostat can also have at least two switching contacts influenced by the temperature sensor and which in each case switch on or off a separate part, i.e. particularly separate radiant elements of the radiant heater at different temperatures. Appropriately each switching contact of the bipolar thermostat switches roughly half the total power of the radiant heater, so that the switching behaviour is similar to that of conventional automatic cast metal hotplates with central sensor, i.e. even in the case of a low thermostat setting initial heating takes place with the full power and is then continued with part of the power. Thus, the radiant heater can only be provided with two radiant elements or heating resistors, which are appropriately positioned parallel to the outsides of the radiant heater and are placed in rectangular or square double spirals in the support shell, in such a way that the radiant heater only has to have four connecting points directly connected to the juxtaposed ends of the radiant elements.

A particularly advantageous further development of the invention is obtained in that at least one radiant element, particularly all such elements of the particular radiant heater can be switched off by means of a cooking utensil identification sensor, which is preferably positioned roughly in the centre of the heating field below the hotplate and is screened by an insulating jacket, so that the temperature sensor is positioned outside the centre of the radiant heater immediately alongside the insulating jacket and parallel to two outsides of the radiant heater. The identification sensor, whose snap switch is appropriately connected in series with the thermostat or power control device, makes it possible to ensure that there is no energy consumption under no-load conditions, despite the switched in radiant heater, whilst on setting down a cooking utensil the full power is immediately available. The identification sensor can e.g. operate optically, but particularly reliable operation is obtained if it is constructed as an inductively operating sensor.

To ensure that the hotplate is tight against food and the like which has run over or spilled, whilst enabling easy cleaning at all times, it is appropriately connected in liquid-tight manner to a frame running round its outer edges, said frame extending at the most up to the plane of the top surface of the hotplate or projects slightly above the same, so that the cooking utensils can always be moved over the border of the cooking unit, without any hard impacts occurring to the hotplate. In certain cases, namely e.g. where, for reequipment purposes, cast metal electric hotplates are to be replaced by radiant heater cooking points, it is also possible to integrate the particular radiant heater with a separate glass ceramic or similar hotplate corresponding roughly to the size of its heating field and to mount same on the rim of an assembly opening of a hob with a carrying rim provided on the hotplate circumference, much as with cast metal electric hotplates. Here again the hob zones adjacent to the heating field can be in one plane and can be connected approximately uninterrupted to the hotplate.

This and further features of the preferred further developments of the invention can be gathered from the description and drawings and the individual features can be realized individually or in the form of subcombinations in any embodiment of the invention and in other fields.

BRIEF DESCRIPTION OF THE DRAWINGS

The embodiment of the invention will now be described relative to embodiments and the attached drawings, wherein show:

FIG. 3: A larger scale detail of FIG. 1.

FIG. 4: Another embodiment of a spring in longitudinal section.

FIG. 5: Another embodiment in a representation corresponding to FIG. 4.

FIG. 6: Another embodiment of a spring in plan view.

FIG. 7: Another embodiment of a spring in a representation corresponding to FIG. 3.

FIG. 8: Another embodiment of a spring in a representation corresponding to FIG. 3.

FIG. 9: A detail of an industrial kitchen cooker provided with a cooking unit according to the invention in a perspective simplified view.

FIG. 10: A vertical section through the cooking unit of FIG. 9.

FIG. 11: A detail of FIG. 10 in perspective view.

FIG. 11*a*: Another construction according to FIG. 11.

FIG. 12: Another embodiment of a cooking unit in vertical section.

FIG. 13: A larger scale detail of FIG. 12.

FIG. 14: Another embodiment of the detail of FIG. 13.

FIG. 15: A radiant heater in vertical section.

FIG. 16: A larger scale detail of FIG. 15.

FIG. 17: The detail of FIG. 16 in a view from the left.

FIG. 18: Another radiant heater in vertical section.

FIG. 19: The radiant heater of FIG. 18 in plan view.

DETAILED DESCRIPTION OF THE PREFERRED EMBODIMENTS

Figure 1:
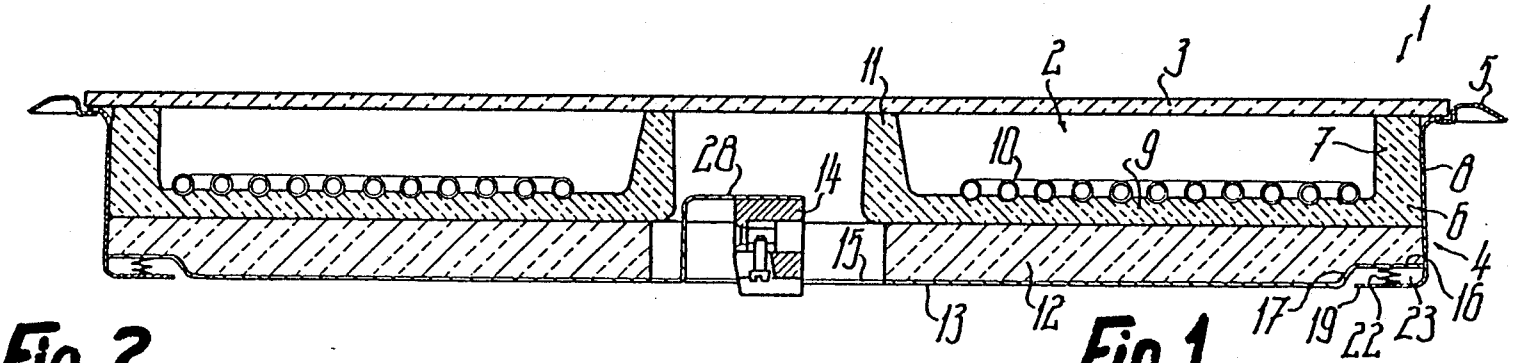
FIG. 1: An inventive cooking unit in vertical section.
Figure 2:
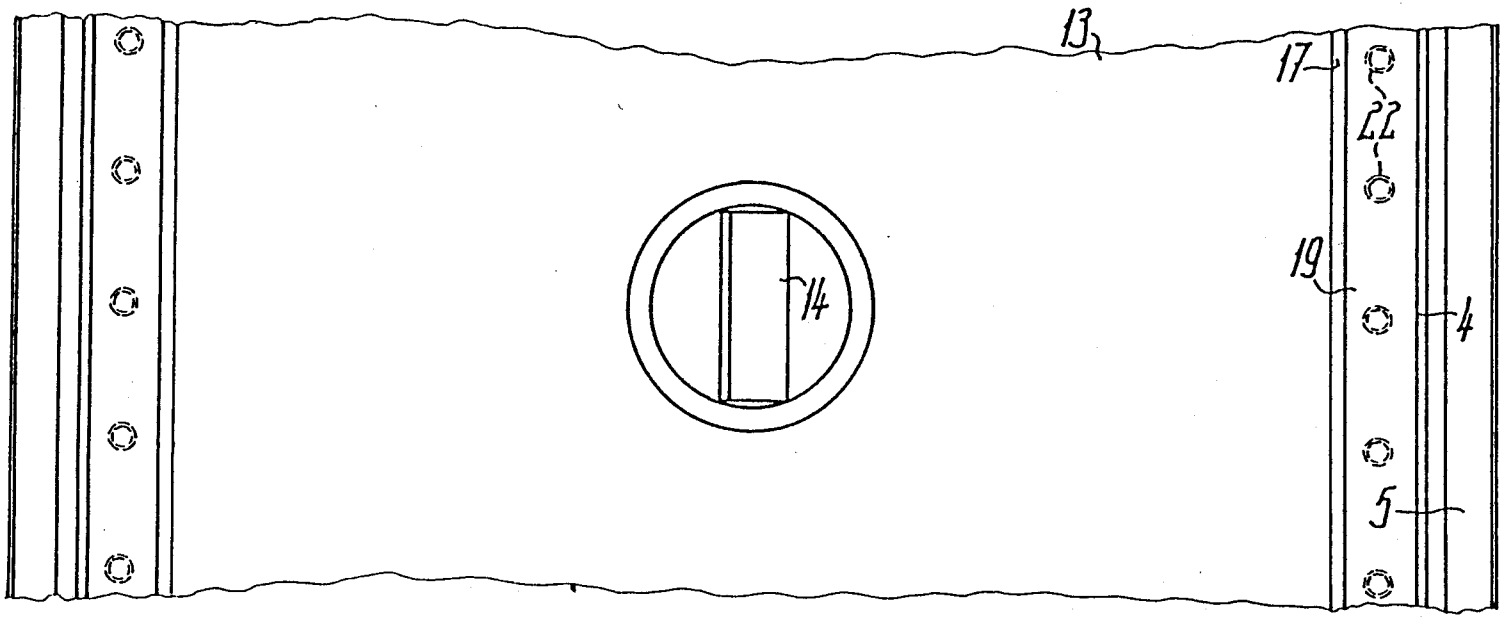
FIG. 2: The cooking unit according to FIG. 1 in a view from below.

Cooking unit 1 according to FIGS. 1 to 3 has a radiant heater 2, a hotplate 3 applied to the top surface thereof, a support 4 resiliently connecting hotplate 3 to radiant heater 2 and a carrying ridge 5 adjacent to the edge surface of hotplate 3 for engaging over the opening rim of a hob or the like. In the represented embodiment, cooking unit 1 is rectangular in ground plan, but for other applications can be round or circular.

Radiant heater 2 has an insulator 6 made from a mineral, moulded fibrous material, which on its side facing hotplate 3 has a base plate 9 roughly parallel to the latter on a relatively large field a heating resistor 10 in the form of a heating coil running in changing directions secured by partial embedding in the insulating material. To the outer boundary of base plate 9 is connected an outer border or rim 7 constructed in one piece therewith and directed against hotplate 3 and which forms the outer circumference 8 of insulator 6 rectangular in cross-section with respect to hotplate 3 and engaging under pressure with its end face in substantially planar manner on the underside of hotplate 3. For the central supporting in the central region of insulator 6 is provided an annular inner ring 11 also constructed in one piece with base plate 9 and bounding the inner region of the heating field, said ring also being resiliently supported with its end face in substantially planar manner on the underside of hotplate 3, so that the central region of hotplate 3 bounded by said inner ring 11 is shielded with respect to the heat radiation of heating resistor 10. The planar bottom surface of insulator 6 is placed on a plate-like insulating layer 12, which has the same ground plan as insulator 6 and has a smaller height or thickness than the latter. On the underside of insulating layer 12 is placed a substantially planar sheet metal cover 13, which also has the same ground plan as insulator 6 or insulating layer 12. Both insulating layer 12 and cover 13 have cutouts coinciding with the inner area of inner border 11 and which are slightly wider than the latter. This leads to a reception zone for a connecting piece 14 for the electrical connection of heating resistors 10, which can be completely countersunk in said reception zone and can be moved or pulled downwards through cutout 15 of cover 13 for connection purposes.

A narrow marginal strip 16 of cover 13 on all the outer edges or over the circumference thereof is substantially uninterruptedly offset in the direction of hotplate 3 by a small amount compared with the thickness of insulating layer 12 that it is parallel to the remainder of cover 13 and passes into the latter via a step 17. This marginal strip 16 terminates by its outer edge flush with the outer circumference 8 of insulator 6 or insulating layer 12. Immediately adjacent to said outer circumference 8 and parallel thereto is provided a pull portion 18 of support 4, which is appropriately formed by a sheet metal section or the like twice oppositely bent on the longitudinal edges. One longer leg 19 of support 4 directly connected to pull portion 18 engages below the marginal strip 16 with limited spacing and over a width which is approximately the same as the width of strip 16, the plane of leg 19 parallel to cover 13 being located in the plane of the underside of cover 13. The other, outwardly directed leg 20 directly connected to the pull portion 18 is adjacent to outer circumference 8 or outer rim 7 on the underside of hotplate 3 and is bonded thereto. Leg 20 extends approximately to the associated edge surface 21 of hotplate 3. Between leg 19 and marginal strip 16 are provided springs 22 in the form of compression springs and in the embodiment according to FIGS. 1 to 3 a plurality of spaced, short, pretensioned helical springs are provided in the longitudinal direction of marginal strip 16. Springs 22 constantly press radiant heater 2 under pretension against the underside of hotplate 3. The projection formed by inner ring 11 and which is consequently also pressed against the underside of hotplate 3 ensures that even the relatively hard strikes to which the hotplate is exposed are damped in such a way that no damage to the hotplate 3 need be feared. Marginal strip 16, leg 19, step 17 and pull portion 18 define a cross-sectionally elongated-flat cavity 23 parallel to hotplate 3 and in which the springs 22 are secured so that they do not fall out, because the gap between the terminal edge of leg 19 and step 17 of cover 13 is much smaller than the width of springs 22.

Carrying rim 5 has a leg 24 engaging below leg 20 of support 4 and bonded with respect thereto, a profile web 25 connected to leg 24 and partly covering the edge surface 21 of hotplate 3 and an outwardly directed, flat cover profile 26 connected to web 25 and which engages over the marginal region of an assembly opening in the associated hob. Profile web 25 approximately parallel to edge surface 21 can be secured with respect to the latter by bonding. Both the individual frames of support 4 and those of carrying rim 5 are interconnected to form an overall closed frame corresponding to the basic shape of hotplate 3 or radiant heater 2.

In the embodiment according to FIG. 4 between marginal strip **16*a* and leg 19*a* the individual springs are replaced by a corrugated spring 22*a*, which is appropriately constructed in one-piece continuous manner over the length of the associated outer edge of the radiant heater. Corrugated spring 22*a* is supported by the convex bow sides of its corrugations on the marginal strip 16*a* and leg 19*a***.

According to FIG. 5 springs **22*b* are in the form of individual, bow-shaped leaf springs, which succeed one another in the longitudinal direction of marginal strip 16*b* and leg 19*b*. Spring 22*b* according to FIG. 6 is also formed by a strip-like leaf spring cutout in meander-like manner along one longitudinal edge, so that spring legs bent out of its plane are formed, which can e.g. be alternately supported on marginal strip 16 and leg 19**.

As shown in FIG. 7, the springs **22*c* can also be annular cup springs, it being possible to use one or two or more equiaxial cup springs between marginal strip 16*c* of cover 13*c* and leg 19*c* of support 4*c***.

Springs **22*d* according to FIG. 8 are constructed in one piece with support 4*d* or its leg 19*d* and are bent out from the same. They have connecting members 27 formed in one piece therewith and constituted by stud-like members, which engage in corresponding connection openings of marginal strip 16*d* of cover 13*d*, so that support 4*d* or springs 22*d* can be locked with respect to cover 13*d*. According to FIG. 8 marginal strip 16*d* is in one plane with the remaining cover 13*d*, so that the latter is slightly displaced with respect to leg 19*d* in the direction of the hotplate. As shown by FIG. 7, the remaining area of cover 13*c*** connected to marginal strip 16c can also be slightly downwardly displaced with respect to leg 19c or support 4c.

Cover 13 forms a flap-like, freely projecting mounting support 28 for connecting piece 14, said mounting support projecting freely into the reception zone formed by inner rim 11 and the associated cutout of insulating layer 12. In the represented embodiment it is twice bent at right angles and is so resilient that if the cooking unit 1, e.g. for stacking purposes, is placed on a surface, connecting piece 14 previously projecting slightly over the underside of cooking unit 1 or cover 13 is forced so far upwards that it no longer projects over the underside of cooking unit 1. Mounting support 28 can also project from cover 13 in upwardly sloping manner into the reception zone. It can also be fixed as a separate flap to cover 13, e.g. using screws. Particularly if the springs or the associated leg of the support can engage in the radiant heater, the support 4 can be fixed to the hotplate 3 prior to the fitting of the radiant heater and then, under resilient shaping, it can be swung outwards in such a way that the radiant heater can be inserted. The support is then swung back until it assumes its predetermined length and optionally engages therein.

As shown by FIGS. 9 to 11, an inventive industrial kitchen cooker 102 is integrated on the top of its housing with a cooking unit 101, which is downwardly defined by an understructure 103 for receiving radiant heaters 104 and upwards by a hotplate 105 parallel thereto, so that a very flat construction is obtained. Hotplate 105 substantially exclusively comprises a continuous, planar glass ceramic plate 106 having a profile frame 107 on the outer periphery and resting by its border on profile legs of the frame is bonded in liquid-tight manner thereto. The bottom-open, e.g. cross-sectionally U-shaped frame 107, in the operating position, engages over the upper edges of the casing walls of cooker 102, so that no liquid or dirt can penetrate the associated joints. The four radiant heaters 104, which are square in ground plan, are in each case resiliently supported with a support shell 109 on spring elements 108, which are supported on understructure 103 and against the spring tension thereof force downwards radiant heater 104 with plate 106. Each support shell 109 has two radiant elements formed from helically bent resistance wire, which is substantially unprotected, i.e. is not encapsulated as is the case with halogen light sources. In the vicinity of the top surface each radiant heater 104 carries a temperature sensor 112 located in contact-free manner below plate 106, but which is not shown in FIGS. 10 and 12 and which makes it possible to control the thermostat 113 associated with each radiant heater 104. Thermostats 113 are arranged on the inside of a front housing shield of cooker 102 and can be adjusted by means of setting knobs 114.

Understructure 103 essentially solely comprises angle sections on two facing outsides of the field commonly bounded by the radiant heaters 104 and a not shown central section, which is parallel to said angle sections between facing sides of the adjacent radiant heaters. The sections are appropriately located in the longitudinal direction of sensor 112, but can also be provided in the depth direction. A horizontal leg 116 of each angle section 115 engages below the associated support shells 109, whilst the vertical leg 117 is immediately adjacent to its outsides. On the insides of the angle sections are fixed, e.g. by welding plate-like spacers 118, one of which is always located between two adjacent radiant heaters 104 and the two others are adjacent to their remote outsides. This leads to the formation of fan-like receptacles 119, into which can be inserted onto the spring elements 108 from above the radiant heaters 104. For each radiant heater 104 are provided four identical spring elements 108 located in the corner regions of its support shell 109 and on which the latter rests with its substantially planar underside in a free manner and without separate fixing. According to FIG. 11a there are merely corner shells 115' limited on three sides, e.g. for the direct fixing to the cooker housing. Support shell 109 and therefore radiant heater 104 are then secured against all lateral movements by legs 117 and spacers 118, with respect to which they can have a small movement clearance, so that with respect to understructure 103 they are substantially only located on spring elements 108 and are otherwise contact-free. Spring elements 108 can in simple manner be formed by helical springs, which are appropriately mounted on a centring pin 120, which is fixed roughly in the centre of the width of leg 116 and adjacent to the associated spacer 118. However, it is also possible to use spring elements or arrangements of the type described in German patent application No. P 36 06 117.4, to which reference should be made regarding the details of such a construction, in which the radiant heater is provided with a separate heating or glass ceramic plate.

In FIG. 10 the outer shell 121 for the support shell 109 is merely a cup-shaped, thin-walled component made from sheet metal or the like, which is arranged on the underside of the base of an insulating shell 122. Apart from the base, insulating shell 122 has an outer rim 123 projecting upwards above the same and which can be constructed in one piece with the base or as a separate part and within which the radiant elements 110, 111 are arranged in spaced manner below its upper end face 124 and the latter completely engages on the underside of plate 106, so that radiant heater 104 is exclusively supported on said plate with insulating material. On the bottom of the outer shell it is also possible to provide an additional thermal insulating layer based on pyrogenic silicic acid, on which engages the entire surface of the thermally and electrically insulating shaped body forming insulating shell 122. However, it is also conceivable to make insulating shell 122 from insulating material based on pyrogenic silicic acid or to connect the radiant elements directly by embedding with the insulating shell 122 and reference should be made to German patent application Ser. Nos. P 31 29 239,9, (equivalent to U.S. Pat. No. 4,471,214) P 35 19 350.6 (U.S. Pat. No. 4,713,527) and P 35 31 881.7 for further details. In the case of such a simple embodiment the insulating shell can be at least partly made from vermiculite, which is especially advantageous for the outer rim 123.

As shown in FIG. 9 heating plate 105 is mounted on the cooker housing so that it can be pivoted upwards about an axis 125 out of the horizontal operating position, axis 125 appropriately being located in the vicinity of the back surface of cooker 102. After flapping up heating plate 105 the radiant heaters 104 are completely free, so that they can easily be removed upwards. If their electrical connections are connected by means of simple couplings, particularly plug-in couplings, to the thermostats 113 and in the case of capillary tube sensors, the temperature sensors 112 can easily be detached from the radiant heaters 104, so that the latter can be replaced in a relatively short time if faulty or if a radiant heater with different characteristics is to be used.

In FIGS. 12 to 19 corresponding parts are given the same reference numerals as in FIGS. 9 to 11, but in FIGS. 12 to 14 are followed by "a", in FIGS. 15 to 17 by "b" and in FIGS. 18 to 19 by "c".

In the embodiment according to FIGS. 12 and 13 each radiant heater 104*a* has an outer shell 121*a* with an upright casing wall, which surrounds on the outer circumference in a substantially spacing-free manner the associated insulating shell 122*a*, but which is slightly set back with respect to end face 124*a*. Angle sections 115*a* are not formed by chamfered sheet metal sections as in the embodiment according to FIGS. 10 and 11, but are e.g. constituted by rolled sections and in the centre between the two angle sections 115*a* is provided a T section 118*a*, whose upwardly directed T foot forms the spacer. Spring elements 108*a* can be directly supported on leg 116*a* with the associated end turn and e.g. according to FIGS. 11 or 11*a* are aligned and secured with a centring pin. As shown in FIG. 14, for centring spring element 108*a* it is also possible to provide a cup-shaped centring piece 120*a* receiving the same on a lower part of its length and which e.g. has an outwardly beaded flange edge by which it is supported with respect to angle section 115*a*. In the represented embodiment, in leg 116*a* of angle section 115*a* is provided a bore adapted to the external diameter of centring piece 120*a*, in which the latter is placed without further fixing in such a way that its flange edge engages on the top surface of leg 116*a* and project downwards. A corner centring of the spring or pin is also conceivable, e.g. in the case of the corner shell 115' according to FIG. 11*a*.

FIGS. 15 to 17 show the temperature sensor 112*b*, which crosses the entire relevant width of the heating field of radiant heater 104*b* bounded by the inner surface of outer rim 123*b*, is located directly below plate 106*b* and is at a smaller distance from the latter than from radiant elements 110*b*, 111*b*, whilst its ends engage in countersunk manner in openings in the upper end face 124*b* of insulating shell 122*b*. Temperature sensor 112*b* has a sensor tube 126 connected by means of a capillary tube 127 to the associated thermostat and which is arranged in substantially contact-free manner in a quartz or similar protective tube 128 equiaxial thereto. This protective tube 128 is only slightly shorter than the associated outer width of insulating shell 126*b*, so that its ends are located within the associated cutouts 130 of outer rim 123*b*. The ends of sensor tube 126 are tapered by squeezing and project through end caps 129 of protective tube 128 in such a way that the wider external diameter main part of the sensor tube 126 also extends into the vicinity of cutouts 130 or outer rim 123*b*. A reduced sleeve shoulder 132 of end cap 129 traversed by the capillary tube engages into an opening 131 provided in the upper end side of the casing of outer shell 121*b* and which has a width-reduced portion in such a way that shoulder 132 is secured against accidental falling out in the manner of a snap connection or a bendable flap with a locking position. Cutouts 130 are wider than opening 131 and are namely adapted to the external diameter of protective tube 128. The connection-free end of the sensor tube or protective tube is completely located within the outer shell 121*b* and is held down with an angular securing member.

As shown in FIGS. 18 and 19, the two radiant elements 110*c*, 111*c* are placed in a double spiral in insulating shell 122*c*, the turns of the two double spirals engaging in one another, their individual portions are parallel to the outer edges of the radiant heater and are equidistantly juxtaposed and the four ends of the two radiant elements 110*c*, 111*c* are parallel juxtaposed adjacent to one corner of the radiant heater 104*c*. These ends can be connected to plug-like connecting pins, which pass through the outer rim 123*c* and outer shell 121*c*, so that they can be connected by joining to a single plug. The radiant elements 110*c*, 111*c* are positioned in such a way that in the centre of radiant heater 104*c* is formed a not directly heated rectangular field 133, i.e. which is free from radiant elements and in which is provided an identification sensor 134 for identifying when cooking utensils are present. The bolt-like identification sensor 134 is at right angles to plate 106*c* and directly on the underside thereof and can be pressed against the underside of plate 106*c* by a suitable spring e.g. supported on the bottom of outer shell 121*c*. Identification sensor 134 is appropriately surrounded by an e.g. truncated cone-shaped insulating jacket 135 which, for further supporting of plate 106*c*, can extend to the underside thereof or, as shown in FIG. 18, can have a limited gap spacing from plate 106*c*. Insulating jacket 135 within field 133 is located as a separate part on the bottom of insulating shell 122*c*, but can also be constructed in one piece therewith. Insulating jacket 135 can also be used for shielding plate 106*c* against excessive heating in the central region of the heating field and reference should be made to German patent application Ser. No. P 35 26 783.6 for further details thereon. Through the positioning of identification sensor 134 or insulating jacket 135, temperature sensor 112*c* is slightly displaced to one side from the centre of radiant heater 104*c*, so that it is immediately adjacent to the outer circumference of insulating jacket 135 and can be additionally supported from below by insulating jacket 135 or can be contact-free with respect to the latter. As is further shown by FIG. 19, the portions of the radiant elements 110*c*, 111*c* are juxtaposed with a relatively small internal spacing, whilst being at roughly the same small distance from the inner face of outer rim 123*c*, said spacings being at the most of the order of magnitude of the helix diameter of the radiant elements and are appropriately at least one third smaller, so that a very considerable heating density is obtained. This arrangement and the almost uninterruptedly juxtaposed arrangement of the radiant heaters ensures over the entire cooking field a very uniform intense heating and the cooking field can be directly heated over at least approximately 90% or even more of its total surface. In the case of a helix diameter of approximately 8 mm, the internal turn spacing is approximately 5 mm.

Figure 20:
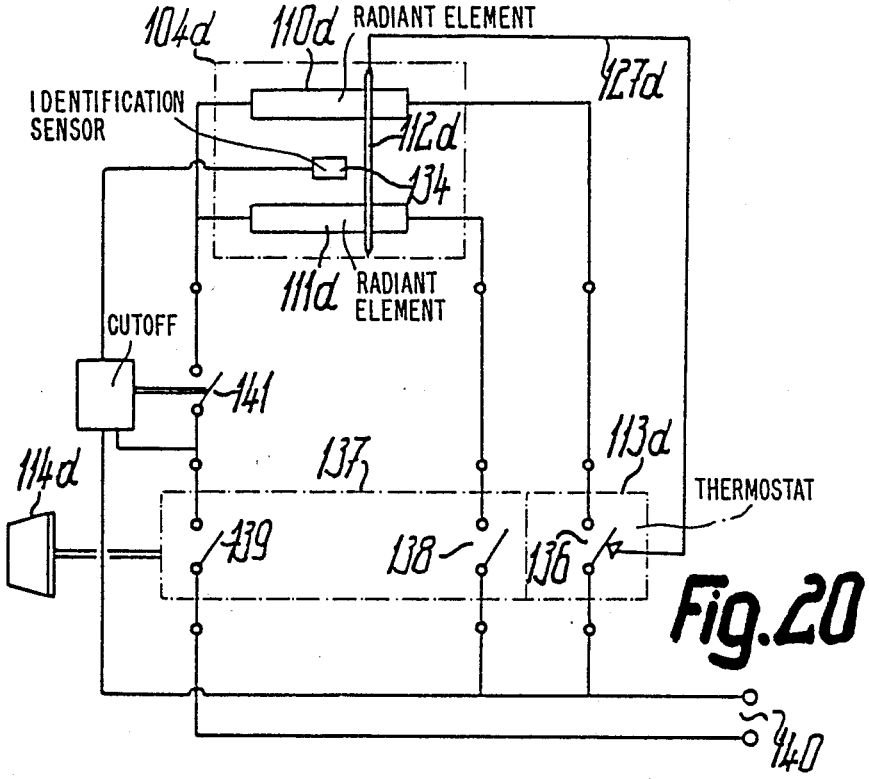
FIG. 20: The circuit diagram for a radiant heater.

In FIG. 20 corresponding parts are given the same reference numerals as in the drawings starting from FIG. 9, but are followed by "d". The two radiant elements 110*d*, 111*d* are arranged in parallel in separate circuits, radiant elements 110*d* being switched by means of a contact 136 of thermostat 113*d* actuated by temperature sensor 112*d*. On thermostat 113*d* is placed a switch 137 constructed in the manner of a power control device, in such a way that it can be operated by means of the same knob 114*d* as thermostat 113*d*. Switch 137 has at least one additional contact 138, which is closed over that range of the setting of knob 114*d* which corresponds with regards temperature to the higher setting range of thermostat 113*d* and additional contact 138 is opened in the lower range. Switch 137 also has a break contact 139, which is closed except in the disconnected position of setting knob 114*d* or thermostat 113*d* and is used in this position for the all-pole separation of radiant elements 110*d*, 111*d* from the power supply 140. Additional contact 138 is arranged in the circuit of the second radiant element 111*d*. In the case of using a bipolar thermostat, the additional contact 138 could also form part of the thermostat. A switching contact 141 influenced by identification sensor 134 is provided in series with the break contact 139 and is open when the heating field is unoccupied and closed when a cooking utensil is placed on it.

This solution also offers the possibility for the automatic preparation of foods, i.e. when setting the thermostat to a temperature value corresponding to further cooking, when a cold pot is positioned thereon initially a high initial cooking power is provided, which is then regulated back with increased cooking utensil temperature. Another advantage of the temperature regulation is therefore that for a given temperature setting a larger amount of power is provided as soon as a cold cooking utensil is placed thereon, whereas the power drops as soon as the cooking utensil is removed and the heating field operated under no-load conditions. This applies to any thermostat setting, so that there is an energy saving under no-load conditions for all the radiant heaters, independently of the thermostat setting. It is generally appropriate to set the front or operating-side radiant heater to a very high or the highest temperature, so that initial cooking can take place by means thereof. The rear radiant heaters are then appropriately set to a finished cooking temperature, so that final cooking can take place thereon of initially cooked food by moving the cooking utensils from the front to the rear of the heating plate.

Figure 21:
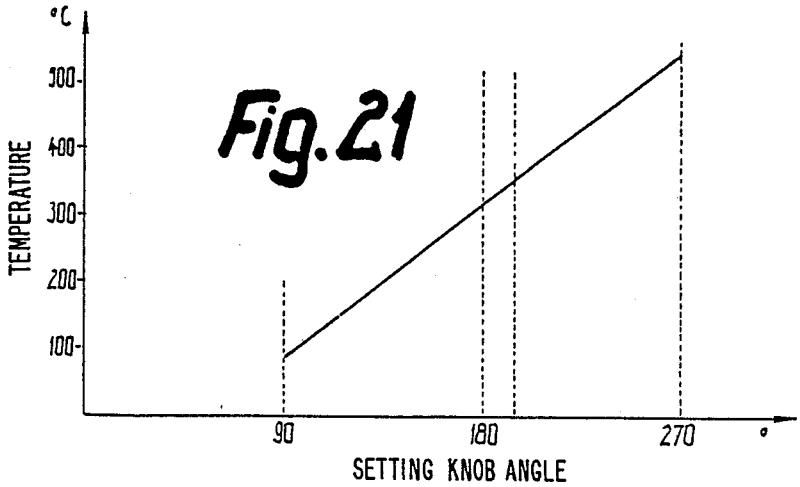
FIG. 21: An example for a temperature characteristic of a heating or cooking field of the hotplate.
Figure 22:
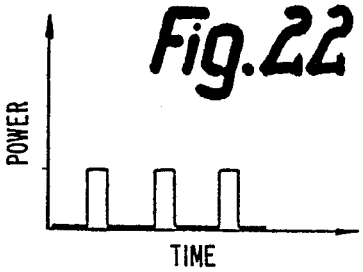
FIGS. 22 and 23: Two examples for regulated power characteristics of a radiant heater.
Figure 23:
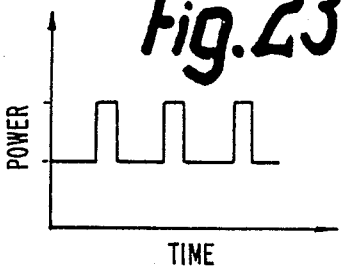

An advantageous adjustment of the control of the radiant elements can e.g. be provided in accordance with FIG. 21 in that with a setting of knob 114*d*, in which it is turned by 90° from the off position, a temperature of approximately 90° C. is provided on the heating plate. Following a further rotation of e.g. 90 radians to 180°, there is a temperature of approximately 300° C. and when the knob is further turned the radiant element 111*d* is connected in via additional contact 138, so that a temperature of over 500° C. can be reached. For as long as only the temperature-dependent regulated radiant element 110*d* is operated, there is a power characteristic according to FIG. 22, in which the power of the complete radiant heater 104*d* is always completely switched off after reaching the set temperature. As soon as the power-controlled radiant element 111*d* is switched in by closing additional contact 138, a basic power of radiant heater 104*d* according to FIG. 23 is constantly maintained, whilst the radiant element 110*d* is operated in timed manner by thermostat 113*d*.

We claim:

1. A cooking unit for cookers and especially for industrial kitchen cookers, said cooking unit comprising:

a top plate arranged at a top of the cooking unit and having bottom and top sides, an entire cooking field being defined on said top side and defining a total surface of said entire cooking field;

at least two separate electric radiant heater means arranged on the bottom side of said top plate, said radiant heater means forming a number of separately controllable cooking points positioned adjacent each other in the entire cooking field of said top plate, each radiant heater means having an external border shape defining outer sides;

each said radiant heater means having at least one radiator heating element defining a heating field, said radiator heating element being arranged in a support shell, thereby providing at least two support shells;

an understructure arranged below said top plate, each said radiant heater means resting against said understructure and being pressed against the bottom side of said hotplate, wherein said understructure is provided with a separate receptacle for each of the radiant heater means, each said receptacle being adapted to an external border shape of a corresponding radiant heater means for receiving said radiant heater means and securing said radiant heater means against all lateral movements, all said receptacles substantially directly adjoining each other, thereby rendering the entire cooking field heatable uninterruptedly over an area of substantially at least 85% of its total surface by said electric heater means, said electric heater means being separately inserted.

2. The cooking unit according to claim 1, wherein all said radiant heater means provide separate heater units of substantially rectangular border shape, having corner portions.

3. The cooking unit according to claim 2, wherein all the radiant heater means provides separate heater units of substantially square border shape, having corner portions.

4. The cooking unit according to claim 1, wherein the separate support shells of said radiant heater means adjoin one another by means of slot-like gaps having a width of approximately only one centimeter.

5. The cooking unit according to claim 1, wherein the receptacles are formed by angular components having substantially horizontal surfaces, said radiant heater means being guided by said receptacles against lateral movement with only a small movement clearance and being independently supported by means of spring elements on said horizontal surfaces.

6. The cooking unit according to claim 5, wherein the angular components engage around edges of corner portions of said radiant heater means.

7. The cooking unit according to claim 5, wherein said angular components are angled profile sections, two lateral profile sections being located on opposite outer sides of said cooking field and a central profile section being parallel to said lateral profile sections and being located between facing sides of adjacent radiant heater means, horizontal legs of said profile sections engaging an underside of said support shells and vertical legs of said profile sections being located directly adjacent to said outer surfaces of said radiant heater means.

8. The cooking unit according to claim 1, further comprising spring elements disposed between the top plate and the understructure, and wherein the top plate is arranged in a raisable flap-up manner, said top plate pressing onto upper end faces of outer rims of the support shells of said radiant heater means, thereby pressing the radiant heater means against the spring elements.

9. The cooking unit according to claim 1, wherein between the radiator heating element and the bottom side of said top plate is provided a temperature sensor of a thermostat, said temperature sensor being substantially parallel to said top plate.

10. The cooking unit according to claim 9, wherein the temperature sensor is rod-shaped and crosses the associated heating field over most of an associated width of said heating field.

11. The cooking unit according to claim 9, wherein the temperature sensor has a member which is provided by at least one of a sensor tube and a protective tube, said member being inserted by at least one end thereof into an opening of a jacket of a sheet metal material outer shell of said support shell.

12. The cooking unit according to claim 11, wherein the temperature sensor, at least in a vicinity of the heating field, is located in substantially contact-free manner in a terminally closed protective tube.

13. The cooking unit of claim 12, wherein the protective tube is a quartz tube.

14. The cooking unit according to claim 1, wherein at least two radiator heating elements are placed in the support shell in rectangular double spirals forming spiral turns, said spiral turns of said radiator heating elements interengaging with each other.

15. The cooking unit according to claim 14, wherein the at least two radiator heating elements are placed in the support shell in square double spirals.

16. The cooking unit according to claim 1, wherein the radiator heating elements of said separate radiant heater means are distributed over essentially the entire heating field, thereby providing a large heating density.

17. The cooking unit according to claim 1, wherein adjacent ones of the radiant heater means are separated by plate-like spacers bounding said receptacles and laterally securing said radiant heater means.

18. The cooking unit according to claim 1, wherein said receptacles are formed by corner shells, each of said corner shells being bounded only on three sides.

* * * * *